United States Patent [19]

Ilg

[11] Patent Number: 4,564,338

[45] Date of Patent: Jan. 14, 1986

[54] HIGH PRESSURE PUMP WITH A FLOW CONTROL VALVE

[75] Inventor: Rudolf Ilg, Aalen, Fed. Rep. of Germany

[73] Assignee: Zahnradfabrik Friedrichshafen, AG., Friedrichshafen, Fed. Rep. of Germany

[21] Appl. No.: 718,299

[22] Filed: Apr. 1, 1985

[30] Foreign Application Priority Data

Apr. 6, 1984 [WO] PCT Int'l Appl. ..... PCT/EP84/00102

[51] Int. Cl.[4] ..... F01B 49/00; F15D 1/04

[52] U.S. Cl. ..... 417/310; 138/39

[58] Field of Search ..... 417/310; 418/180, 259, 418/267, 268; 138/39, 92; 406/193

[56] References Cited

U.S. PATENT DOCUMENTS 2,590,797 3/1952 Siciliano ..... 138/39
3,977,730 8/1976 Seick ..... 406/193

FOREIGN PATENT DOCUMENTS 731646 6/1955 United Kingdom ..... 406/193
2076057 11/1981 United Kingdom ..... 417/310

*Primary Examiner*—Leonard E. Smith
*Assistant Examiner*—Jane E. Obee
*Attorney, Agent, or Firm*—Zalkind & Shuster

[57] ABSTRACT

A vane pump having a flow regulating bypass valve activated by outlet pressure to direct excess flow back to the inlet is provided with a channeling having an element comprising a plug insertable in the valve housing, which plug has a specially shaped flow bend in the form of an arcate groove that forms a smooth transition for combined flow from a tank fed inlet and from the bypass valve to the pump inlet. This is effected by connecting a channel from the tank inlet and bypass valve to a channel for flow return to the pump inlet which channels are angularly related. Since the valve housing is die cast the difficulty of providing, in a casting, an exactly shaped smooth surfaced and accurately dimensioned transition passage between the aforementioned channels is overcome by the invention. The plug itself may be die cast or molded of plastic and effects a combined flow which is substantially laminar for smoothly efficient passage to the pumping chambers between the vanes of a vane pump, so as to provide a high efficiency of charging under suction pressure.

12 Claims, 3 Drawing Figures

FIG.1
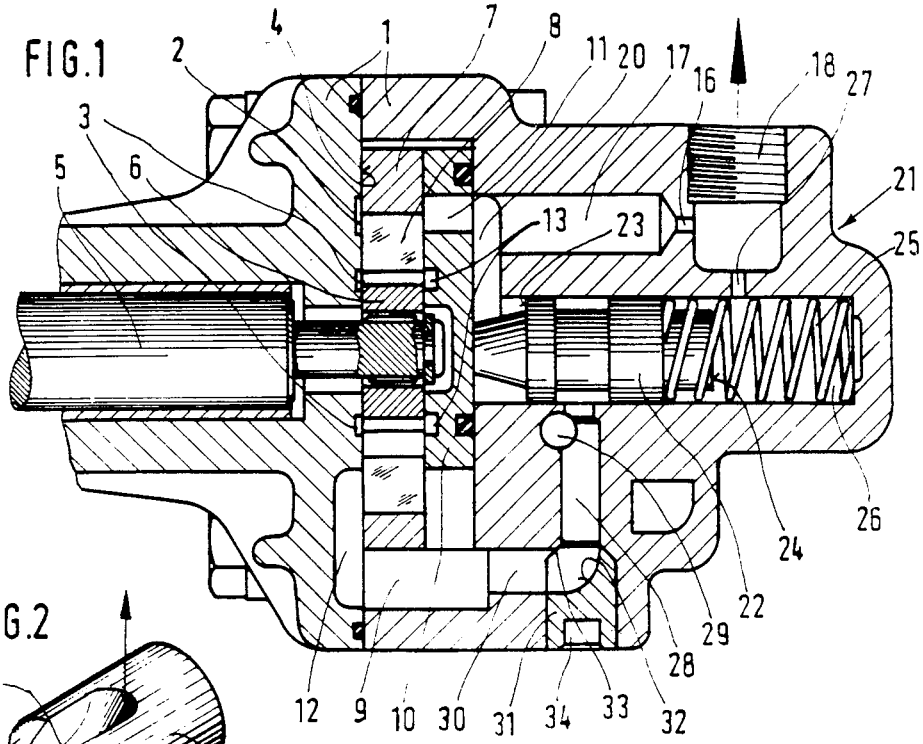
FIG.2
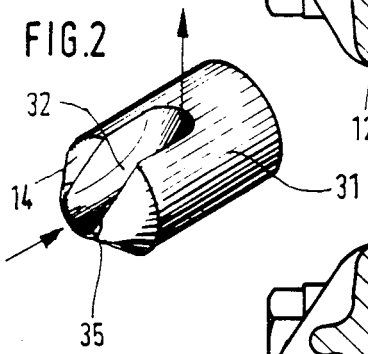
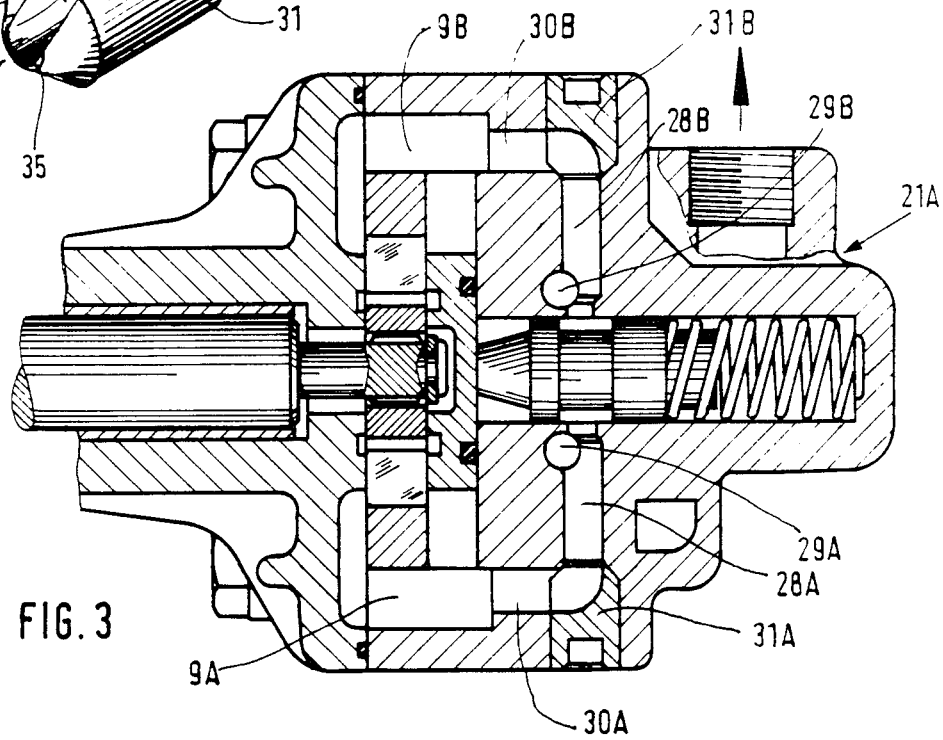
FIG. 3

HIGH PRESSURE PUMP WITH A FLOW CONTROL VALVE

BACKGROUND OF THE ART

A high pressure pump of the type described herein is shown in German OS No. 30 18 650 in which a bypass channel of a regulating bypass is disposed at about a right angle to a longitudinal inlet channel leading to the suction side of a vane pump. The bypass channel is closed by a flat face of a screw plug held flush with the longitudinal channel. As a result, favorable flow conditions are effected in the change of flow direction so that the partial flow regulated by the bypass valve has an improved feed to the suction side or to the inlet passage of the pump. The improved effect is due to the fact that the inlet oil flowing in from a feed passage connected to a tank is entrained by the partial bypass flow from the bypass valve under more or less high pressure.

BRIEF DESCRIPTION OF THE INVENTION

The invention further lowers flow resistance in the angular transition area between the angularly related channels to effect a more efficient charging of the pumping chambers between the vanes.

The invention utilizes a plug with a groove having a semicircular bottom in cross section with flat sides and of longitudinal curvature. Accordingly, an almost laminary flow of oil occurs of the combined inlet feed and bypass flow with considerably decreased turbulence loss.

In order to essentially maintain a full flow groove cross section, the adjacent juncture edge of the bypass channel is specially formed at the transition into the arcuate groove of the plug by having a portion of the edge removed so as not to obstruct flow into the plug groove.

The invention may be used advantageously in connection with vane pumps of single or double stroke. Also, the double stroke pump may be equipped, according to choice, with one or two bypass channels. With two bypass channels, the charging pressure is even further increased. Additionally, the piston of the pressure operated bypass valve is compensated hydraulically by back pressure from the consumer device, being thus subject to differential pressure. Advantageously, the plug is produced as a diecasting from metal or as a plastic injection molded part.

The inlet charging of the van chambers is improved as a result of the invention which is particularly effective with pumps operating at very low pressure in idling, and at higher rpms. Damage caused by cavitation which may lead to a premature failing of the pump is avoided. As a consequence of the improved charging the operating noises of the pump are also lower.

A detailed description of the invention now follows in conjunction with the appended drawing in which:

FIG. 1 shows a longitudinal cross section through a double stroke vane pump with a bypass valve and a bypass channel, the section being as though they were lying in one plane;

FIG. 2 shows separate plug in enlarged perspective which is insertable into the pump housing;

FIG. 3 shows a vane pump embodiment similar to FIG. 1, but with two bypass channels, plugs, and inlet channels.

The double stroke pump of FIG. 1 has a die cast housing 1. A portion of the housing has cheek plate surface 4 with partially ring-shaped oil channels 2 and 3. In the housing 1, a drive shaft 5 is supported which carries a rotor 6 on tooth keying. The rotor 6 contains a number of radial slots in which radially movable operating vanes 8 slide against a cam ring 7. A sealed cheek plate 10 is supported on the cam ring 7. The plate 10 has two openings 11 acting as pressure passages, the upper opening being shown in FIG. 1. The oil channels 2 lie opposite openings 11. The two pressure zones of the pump lie in the area of openings 11. Partially ring-shaped oil channels 13 corresponding to the oil channels 3 connect the lower vane pumping chambers of the operating vanes 8 with a pressure chamber 20 by way of bores, not shown. Pumping chambers, not apparent in the drawing, between the operating vanes 8, the rotor 6 and the cam ring 7 are connected by way of two inlet passages 9 (in the drawing only one is visible) with a suction connection (not shown). For the purpose of better distribution of suction intake of oil into the pumping chambers, housing recesses 12 lie opposite the inlet passages 9. The output oil under pressure from vanes 8 reaches the pressure chamber 20 via openings 11. From there, the output pressure oil flows by way of a housing bore 17 via a restrictor orifice 16 to an outlet connection port 18.

A bypass or regulating valve 21 is pressure operated and coaxial with the drive shaft 5. The bypass valve has a valve piston 22, with a face 23 exposed to pressure in pressure chamber 20. A spring 25 acts against a face 24 of the piston opposed to pressure against face 23. In addition, the face 24 encloses a pressure chamber 26. The pressure chamber 26 connects to the port 18 via a choke orifice 27. The bypass valve 21 operates in a known manner. Thus, oil under pressure from the vanes 8 flows into the pressure chamber 20 and thence as pressure flow via the bore 17 and the restrictor orifice 16 to port 18 for connection to a consumer device. With increasing rpm of the pump and due to the restrictor orifice 16, the differential pressure on the face 23 increases, which forces the piston 23 against the bias of the spring 25 and counter to the force of consumer device pressure prevailing in the pressure chamber 26. A partial flow thus reaches a bypass channel 28 and by way of an angularly related longitudinal inlet channel 30 which is in communication with bypass channel 28 flow passes to the inlet passage 9. An inlet feed passage 29 from a tank under suction force connects into the bypass channel 28. The bypass channel 28 for reasons of production (diecast construction element) is cast as a passage. The bypass channel 28 is closed by a plug 31.

A longitudinally arcuate groove 32,substantially a right angle bend, connects the bypass channel 28 with the substantially right angled longtiudinal inlet channel 30 and is formed in the plug 31 (FIG. 2) at its front, i.e., upstream end 14. The direction of flow in the groove 32 is indicated by arrows and the end 14 is conically tapered. The groove 32 has a semi-circularly shaped radial bottom cross section. The downstream end 33 of the bypass channel 28 has a minimum length of taper where it meets the open side of the groove, as shown so that the flow cross section of the groove is essentially maintained. In order to achieve good transition of flow, the plug 31 is also provided with a chamfer 35 at the end of the semi-circular bottom, as shown. The smoothly angular directing of the flow of oil in the longitudinally arcuate groove 32, whereby the cross section flow areas of the channels 28 and 30 are essentially maintained, effects considerably fewer losses of flow and a particularly good pump chamber charging of the pump on the suction side.

For the mounting of the plug, the pump is held in a suitable fixture and the plug 31 is force fitted as by stamping in recess 34, due regard, of course, being had for exact orientation.

The plug 31 may be produced economically as a diecast part, for example. of aluminum or formed as a plastic injection molding, substantially as shown for sealingly coupling the bypass and inlet channels.

FIG. 3 shows the embodiment of the pump with two bypass channels 28A and 28B and corresponding plugs 31A or 31B. The bypass channels 28A and 28B are connected with a common suction connection, not shown, by way of respective feed passages 29A or 29B. Each of the inlet channels 30A and 30B is connected with an inlet passage 9A and 9B. In feeding bypass oil as regulated by bypass valve 21A into two bypass channels 28A and 28B, the charging pressure in the feed passages 29A and 29B may be increased considerably as compared to the pump described in FIG. 1 having only one bypass channel.

I claim:

1. In a high pressure vane pump of the kind having a housing with a bypass valve for flow regulation wherein a bypass channel combines bypass flow with inlet feed flow from a tank and an angularly related inlet channel communicates with the suction side of a vane pump, including a flow transition member between opposed open ends of the channels;

the improvement wherein said transition member comprises a plug fitted into said housing and having a groove shaped to form a flow juncture between said opposed ends.

2. In a high pressure vane pump as set forth in claim 1, said bypass channel having open end (33) in said housing with an internal taper; said groove having a generally semi-circular inside bottom and having an external end taper at one end of said semi-circular bottom for complementary abutting engagement with the internal taper opening of said open end of bypass channel (28).

3. In a high pressure vane pump as set forth in claim 2, wherein said internal taper of said bypass channel is of minimum length at the adjacent open side of the groove so as not to obstruct flow through the cross sectional area of the groove from the bypass channel.

4. In a high pressure vane pump as set forth in claim 3, wherein the periphery of said internal taper having a minimal length engages with a chamfer (35) on the edge of said semi-circular bottom.

5. In a high pressure vane pump of the kind having a housing (1) and therein a cam ring (7) and a rotor (6) on a drive shaft (5) carrying vane (8) operable in rotation within said cam ring, including a pressure chamber (20) in said housing and a flow directing cheek plate (10) in said housing in surface engagement with said cam ring for axial support thereby and having pressure passage means(11) communicating pressure from said vanes to said pressure chamber, said housing also having a bypass flow regulating pressure operable valve (21) communicating with said pressure chamber and connecting with a bypass channel (28) including an inlet feed passage (29) for connection to a tank and connecting to said bypass channel for communicating combined flow from said bypass valve and said inlet feed passage when said bypass valve is actuated by pressure in said pressure chamber, said bypass channel communicating through a flow transition means (31) with an inlet channel (30) and means (12) communicating said inlet channel to the suction side of said pump; wherein said latter channels are angularly related; the improvement comprising said flow transition means being a plug having an arcuate groove (32) shaped to join said angularly related channels for continuous flow connection therebetween and being fitted into said housing for sealingly coupling opposed open ends of said angularly related channels.

6. In a high pressure vane pump as set forth in claim 5, wherein the bypass flow channel (28) area, the inlet feed passage (29) and the grooved plug (31) and the inlet channel (30) are duplicated to provide two flow paths comprising bypass flow channels (28A, 28B) and inlet flow passages (29A, 29B) and grooved plugs (31A, 31B) and inlet channels (30A, 30B).

7. In a high pressure vane pump as set forth in claim 1, said grooved plug being die cast.

8. In a high pressure pump as set forth in claim 1, said grooved plug being injection molded of plastic material.

9. In a high pressure vane pump as set forth in claim 1, said bypass channel having open end (33) in said housing with an internal taper; said groove having a generally semi-circular inside bottom and having an external end taper at one end of said semi-circular bottom for complementary abutting engagement with the internal taper opening of said open end of bypass channel (28).

10. In a high pressure vane pump as set forth in claim 9, wherein said internal taper of said bypass channel is of minimum length at the adjacent open side of the groove so as not to obstruct flow through the cross sectional area of the groove from the bypass channel.

11. In a high pressure pump as set forth in claim 10, wherein the periphery of said internal taper having a minimal length engages with a chamfer (35) on the edge of said semi-circular bottom.

12. In a high pressure vane pump as set forth in claim 11, wherein the corresponding passages, channels and grooved plugs are diametrically arrayed relative to the axis of rotation of said pump.

* * * * *